US006494819B1

(12) United States Patent
Boland

(10) Patent No.: US 6,494,819 B1
(45) Date of Patent: Dec. 17, 2002

(54) ABS ROVER EXERCISE MACHINE

(76) Inventor: Kevin O'Brien Boland, 5623 Massachusetts, Bethesda, MD (US) 20816

( * ) Notice: Subject to any disclaimer, the term of this patent is extended or adjusted under 35 U.S.C. 154(b) by 0 days.

(21) Appl. No.: 09/985,660

(22) Filed: Nov. 5, 2001

Related U.S. Application Data

(60) Provisional application No. 60/297,525, filed on Jun. 13, 2001.

(51) Int. Cl.[7] ..... A63B 23/02

(52) U.S. Cl. ..... 482/130; 482/140; 482/121

(58) Field of Search ..... 482/121, 122, 482/123, 96, 129, 130, 133, 134, 139, 140, 142, 908; D21/662, 673, 676, 686, 691

(56) References Cited

U.S. PATENT DOCUMENTS 5,730,688 A * 3/1998 Prusick ..... 482/130
6,022,303 A * 2/2000 Abdo ..... 482/121
6,056,676 A * 5/2000 Adams ..... 482/112
6,248,047 B1 * 6/2001 Abdo ..... 482/142
6,312,366 B1 * 11/2001 Prusick ..... 482/130

* cited by examiner

*Primary Examiner*—Stephen R. Crow
(74) *Attorney, Agent, or Firm*—A. R. Eglington

(57) ABSTRACT

A combined abdominals (main and lower abs)/thighs/calves exercise device, which composes a base support member assembly upon which the user sits, a partially vertical and horizontal resistance mast with resilient restorative properties mounted upon the base support member support, and a collar oriented upon the upper mast. A bracket means is reciprocally mounted upon the collar and is adapted to hold a range of vertical positions along same. A pair of grippable bars transversely mounted upon the outer end of bracket means, which bars permit the user to train and strengthen major and minor muscle sets dependent upon the physical orientation of the grippable bars.

10 Claims, 5 Drawing Sheets

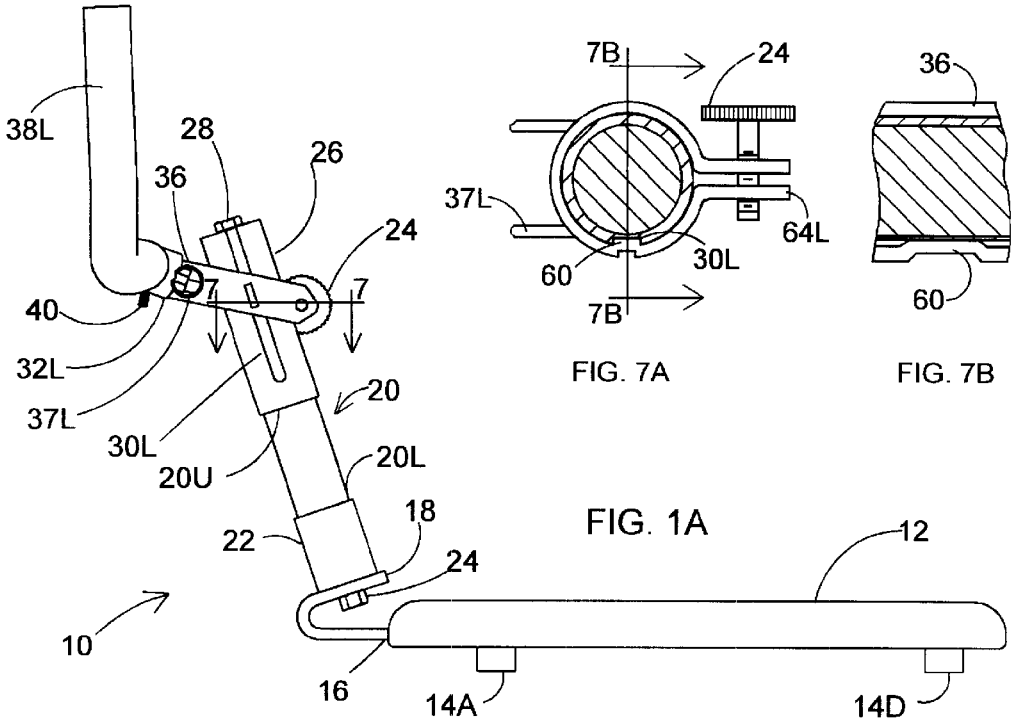
FIG. 1A
FIG. 7A
FIG. 7B
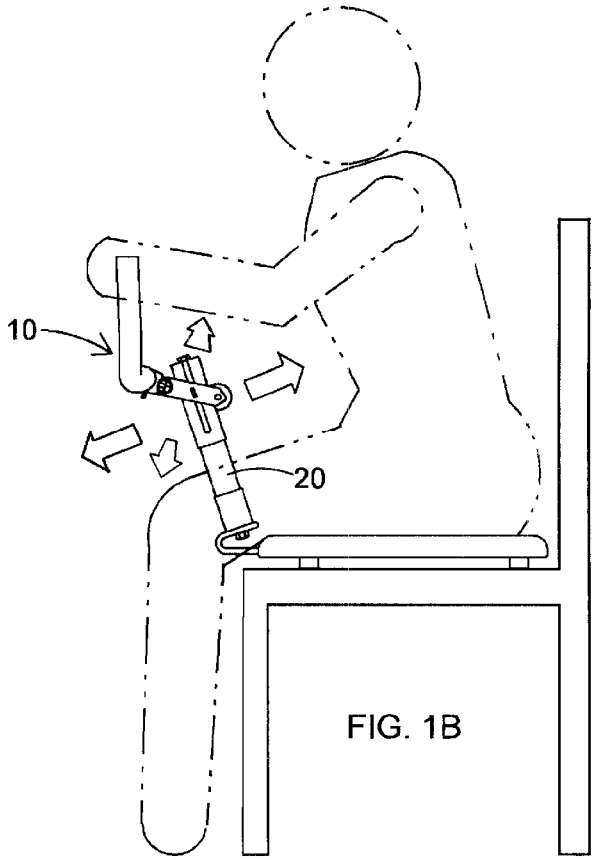
FIG. 1B

ABS ROVER EXERCISE MACHINE

CROSS-REFERENCE TO OTHER APPLICATIONS

This is a continuation in part of my copending provisional Specification of filing Jun. 13, 2001, accorded U.S. Ser. No. 60/297,525.

FIELD OF THE INVENTION

The present invention relates to a portable and easily storable device for selective torso muscle conditioning and development.

BACKGROUND OF THE INVENTION

While there are a large number of multi-exercise machines on the market, there is a need for an economical and efficient one which focuses on conditioning the torso and the related upper/lower ABS muscles. A device of simplified construction, yet having versatility of uses, is much to be desired.

Abdo U.S. Pat. No. 6,022,303 of Feb. 8, 2000 is to an abdominal exercise device and describes one in which the vertical resistance member 22 (FIGS. 1–6) provides for its deflection only in a horizontal plane for its U-shaped arm support member 23 mounted thereon. This limitation permits only a torso (trunk) rotational exercise while a user is gripping hand grasps 37/38. Similarly, Prusick U.S. Pat. No. 6,146,317 of Nov. 14, 2000, is described for strengthening abdominal and lower back muscles, but permits rotation of his flexible mast 30 only in a reciprocal vertical plane by the user exerting backward pressure against resilient member 30.

By contrast with the present invention, having mast 20 (FIG. ½) being disposed at an angle, such allows for deflection within both the horizontal and vertical planes, whereby the larger number of exercises are made possible, specifically main ABS, oblique ABS, lower ABS, thighs, and calves.

The presently disclosed device has additional useful features, the first being an adjustable height, sleeve-like collar riding on the mast component. The resulting adjustable height of the U-shaped grippable bands can accommodate the varying heights of users, and offer two modes when the bracket setting on the collar in the upper reach for the main ABS and oblique ABS, and alternatively, the bracket setting is in its lower reach for lower ABS, thighs, and calves.

The slidable collars provide it with a plunger pin 40 (FIG. 2) which allows the associated handles to more move upwardly and/or downwardly quite readily, affording the alternate exercise modes of operation.

By now providing for the mast and associated handles to be aligned proximal to, and anchored centrally of the seat component forward edge, this triples the number of body exercises that can be enjoyed with the device employing a single mast. In this arrangement, the user can perform a front rotation while the device straddles a chair available in the home.

It is, therefore, a principal object of the invention to provide a portable torso/abdominal (ABS) exercise machine that exercises the entire torso muscle set, and, secondarily, works the thighs and calf muscles.

It is a still further object of the invention to use the arms and thighs to provide the force needed to effect a workout of the ABS/and calves muscles.

It is a still further object of the invention to provide for ABS-calves exercises without need for inclusion of a counter resistence means, like dampers and/or weighted pulley sets.

A yet further object of the invention is provide a portable exercise device which is positioned upon a supporting chair, temporarily anchored in place by the user's weight, and relies on inherent resilience of a single device component to provide the resistance needed to the exertion of user's arms and thighs.

SUMMARY OF THE INVENTION

The operating advantages of the present device include: (a) the support mast serving as a restorative force member and affording repetitive resistance; (b) an angled energy restorative force member providing for both vertical and horizontal deflections and thus plural exercises with one portable machine; (c) handles heights being adjusted vertically on the resilient mast for alternative sets or exercises with either a handy upward or downward orientation of the grippable handles.

According to the invention, there is provided a multi-exercise device adapted to be positioned during use on an conventional armless and firm supporting chair, while being temporarily pinned thereto, by virtue of the weight of a user seated astraddle same upon the cushion component of the exercise device; an elongated rigid first member is provided which is secured lengthwise of the seating pad preferably on the undersurface along its proximal (to the user) longitudinal end, and having a formed but resilient single mast member, which mast is anchored at the lower end thereof to the distal longitudinal end of the elongate first member; the centrally-located mast member is slanted outwardly and fixedly from its lower anchor point; a slidable, rigid collar-like member is mounted normally proximal on the upper longitudinal end of the mast member; an elongate, two element bracket set is adapted to straddle the collar component in a fixed angular juxtaposition, which bracket extends outwardly and upwardly; such bracket can be shifted along same to varied horizontal positions, and locked thereat, so as to accommodate the physical dimensions of several users; a cylindrical bar is journalled horizontally and transversely through the outer longitudinal ends of the bracket set; a set of laterally extending, handle bars are pivotally secured to the cylindrical bar outer ends; the handle bar set is rotatable between an upper and lower extension modes of orientation, depending upon which exercise groups are intended: (a) arms in upright position—torso/upper and main Abs; and, (b) arms folded in down position—lower Abs, calves, and thighs.

The mast member is fabricated from somewhat flexible material of construction, like polyurethane, which thus provides some resistance to torso flexing in any of one of several directions which are being imposed thereon by the user's arms and knees. The polyurethane flexible rod (black in color) is a counter resistance means for this product.

BRIEF DESCRIPTION OF THE DRAWINGS

FIG. 1A is a side elevational view of the torso exercising machine of the present invention with a grippable handle component, oriented upwardly and outwardly, and isolated from any underlying support means;

FIG. 1B is a reduced silhouette view of the device of FIG. 1A now supported upon the seatable portion of an armless chair with a user positioned to straddle the device and now being in position mode for conduct of an upper abdominals exercise routine, including fall trunk rotation;

FIG. 7A is a horizontal cross-section of the bracket sleeve components, taken along line 7—7 of FIG. 1A; and, FIG. 7B is another horizontal cross section, taken along line 7B—7B of FIG. 7A, depicting the inner configuration of the engaged components.

DETAILED DESCRIPTION OF A PREFERRED EMBODIMENT

Figure 2:
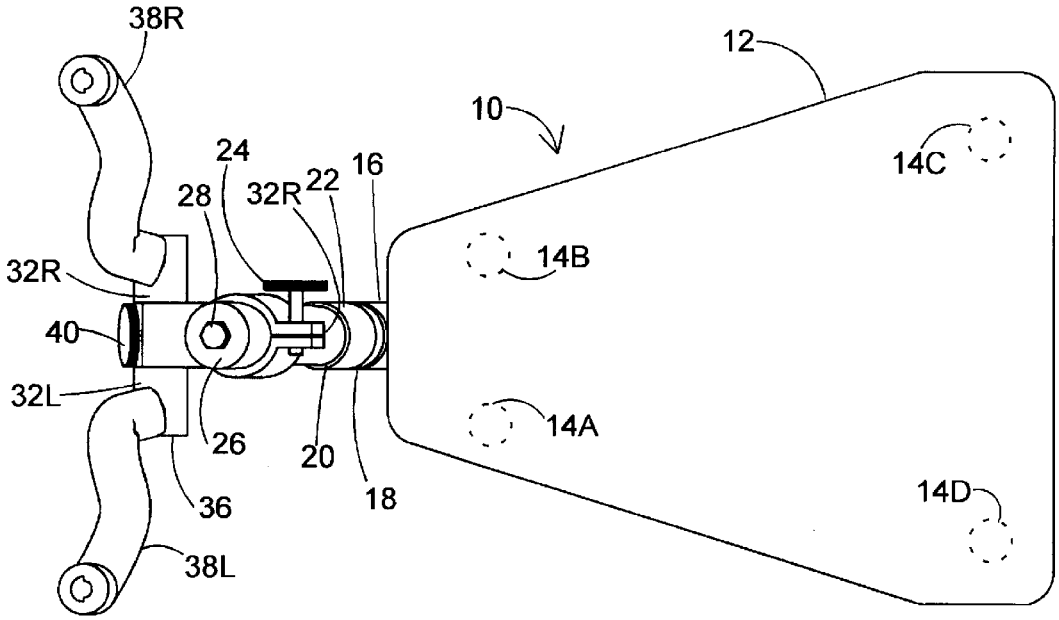
FIG. 2 is top elevational view of the torso exercising device of FIG. 1A, also isolated from any underlying support means.

FIG. 1A is a side elevation view of an exercise device, generally 10, comprised of a cushion seat component 12, having an underlying set of seat-contact pegs 14A; an underlying elongate rigid bar 16 having its distal (from user) longitudinal end 18 in the shape of rigid acute angle; a somewhat resilient elongate rod 20 pinned at its lower end 20L to angle end 18, with a closed end, rod-retaining sleeve 22 encasing lower rod end 20L, and with sleeve 22 being retained pinned to rigid bar end 18 by axial bolt 24.

The upper longitudinal end 20U of rod 20 has mounted thereon a formed, closed end, elongate collar 26, retained via an upper end, axial head bolt 28 that pierces the one closed end cover to engage the rod end 20L to which it is fixedly secured. The upper collar also has a pair of diametrically-opposing, linear grooves, 30L/R, inscribed longitudinally of the collar 26. A two-component elongate bracket, 32L/R, embraces the upper segment of collar 20U, having a fixed obtuse angle relative to the slanted upward and outward alignment of rod 20 itself. Bracket set 32 is adapted to be interuptably locked in a vertical position anywhere along the external groovings, 30L/R, by locking engagement of side knob 24, bridging the inner ends of the bracket assembly.

Proximal the outer longitudinal end 32L of bracket 30, a cylindrical rod 36 bridges and interconnects the bracket 30 outer ends, 32L/R (see FIG. 2). Rod 36 is sized and adapted to be rotatable within the bores 37L/R provided in the bracket outer segments 32L/R (See FIG. 1A).

At the outer longitudinal ends of rotatable spanning rod 36, are pinned an opposing set of hand grippable, arched bars, 38L/R, which are conveniently free-end cushioned. As depicted in FIGS. 1A/B, these "handlebars" in the first mode of use, are oriented outwardly and upwardly so as to facilitate their manual gripping by the partly arched arms of the device user, and also to fit the curvature of one's thighs in the secondary exercise modes.

The schematic of FIG. 1B indicates a reciprocal to and fro motion of the user torso, including full trunk rotation, with resilient main rod 20 providing the sole resistance to user exertions. Depicted is the initial at rest position of the device then set to effect exercise of the upper ABS muscles. While not specifically depicted, the depicted mode of operation also serves to conduct torso rocking motions laterally and in all directions; i.e., from left to right, vice versa, frontward and backward, vice versa, and other combinations, as indicated by the action arrows.

Averting now to the top plan view of FIG. 2, certain of the operative components are better depicted and described as follows. The outward, as well as upward, orientation of the handlebar component, 38L/R, is evident in FIG. 2. Forward, spring-loaded knob 40 is located centrally of bracket set, 32L/R, and serves to set the adjustment of the handles, upwardly or downwardly, such is provided by spanning rod 36 rotation to the user-imposed force being exerted on the associated handlebars. End knob 40 can be spring-loaded, so that its stem normally locks against cylindrical rod 36, but transient withdrawal permits handles 38 rotation. Normally, set knob 40 is tightened so as to maintain the alternate juxtapositions of bar 36 and handles 38 (either FIG. 1A or 4A), then is withdrawn to permit rotation of the bars to the alternate working position of FIG. 4A. Knob 40 is retightened to maintain that downward setting, the one providing for the lower ABS, thighs, and calves exercises being effected.

Figure 3A:
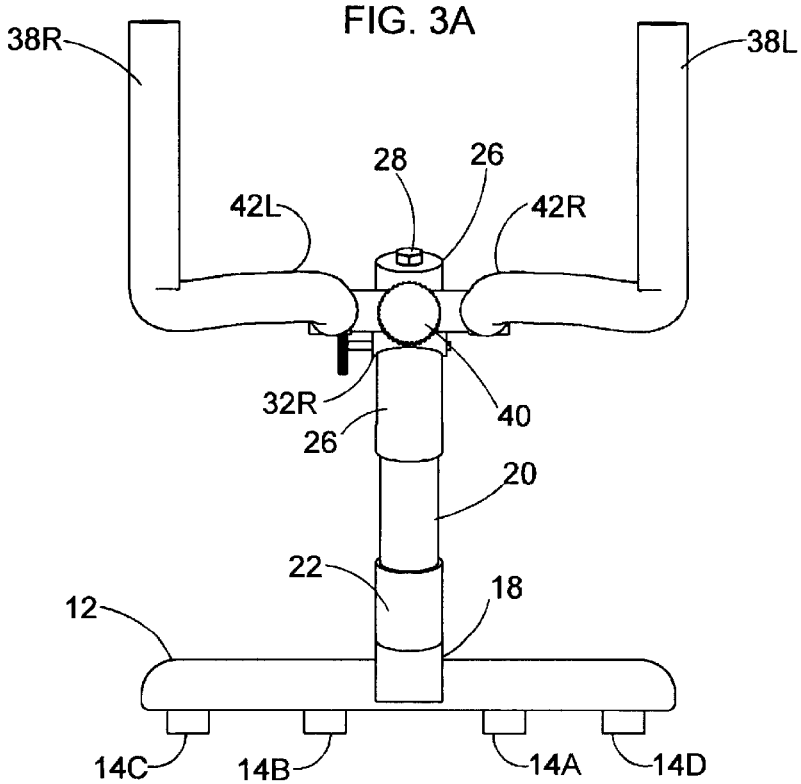
FIG. 3A is a front end elevational view of the exercise device of FIG. 1A.
Figure 3B:
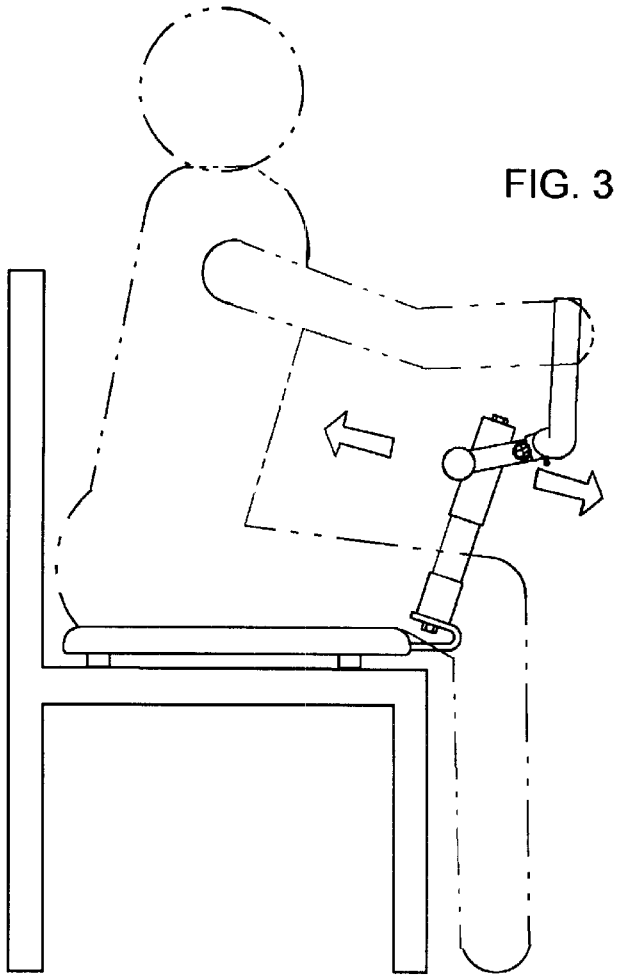
FIG. 3B is a side elevational view of the machine of the present invention being employed in the trunk rotation exercises.

FIG. 3A provides another elevational front end view of the plural operating components of the present invention. Note that only the flexing of resilient rod 20 provides resistance to the user efforts. The schematic of FIG. 3B clearly shows handles 38L and 38R, which the user grasps in performing the trunk rotation exercises.

Figure 4A:
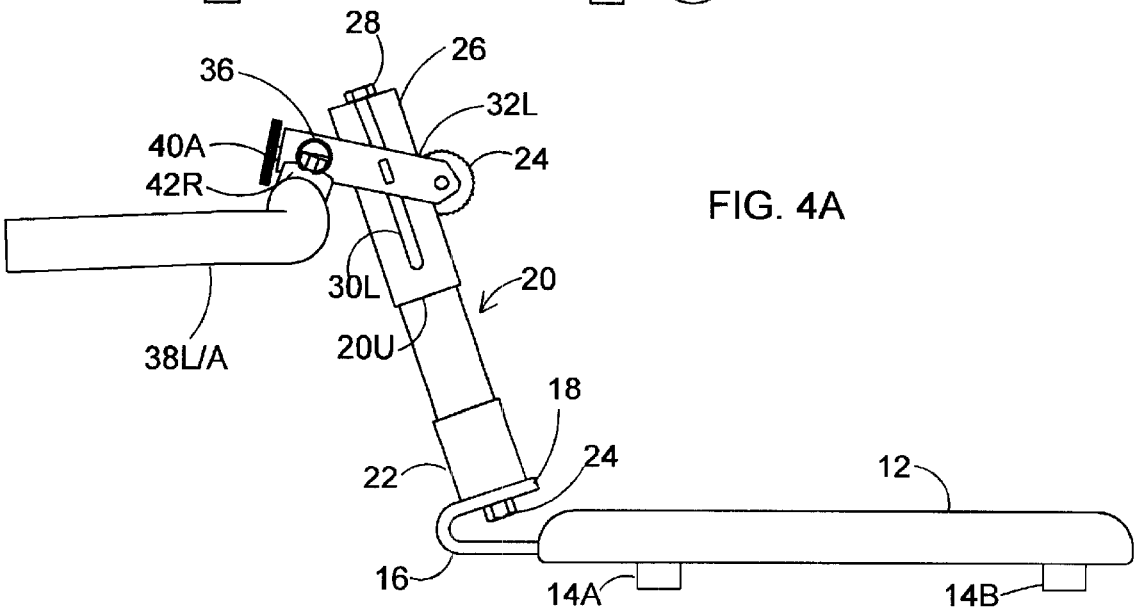
FIG. 4A is a side elevational view of the torso exercising device of the present invention, now having its grippable handles component reoriented downwardly and outwardly, so as to conduct the combined lower abdominal/thighs/calf exercises.

Looking now to the alternate position exercise device position of FIGS. 4A, it is noted that the handlebars, 32L/R, after locking knob 40A has first been relaxed, have been rotated downwardly to that depicted horizontal juxtaposition. This user orientation does not require any hand engagement, but causes the inner bar segments, 42L/R (see FIG. 5A), of the bars to arrest upon the closed user thighs (see FIG. 4B), ready for the lower ABS/thighs/calves conditioning. Two exercises, the toes raised for the calves and the lower ABS, are done in this orientation as shown in FIG. 5B.

Figure 4B:
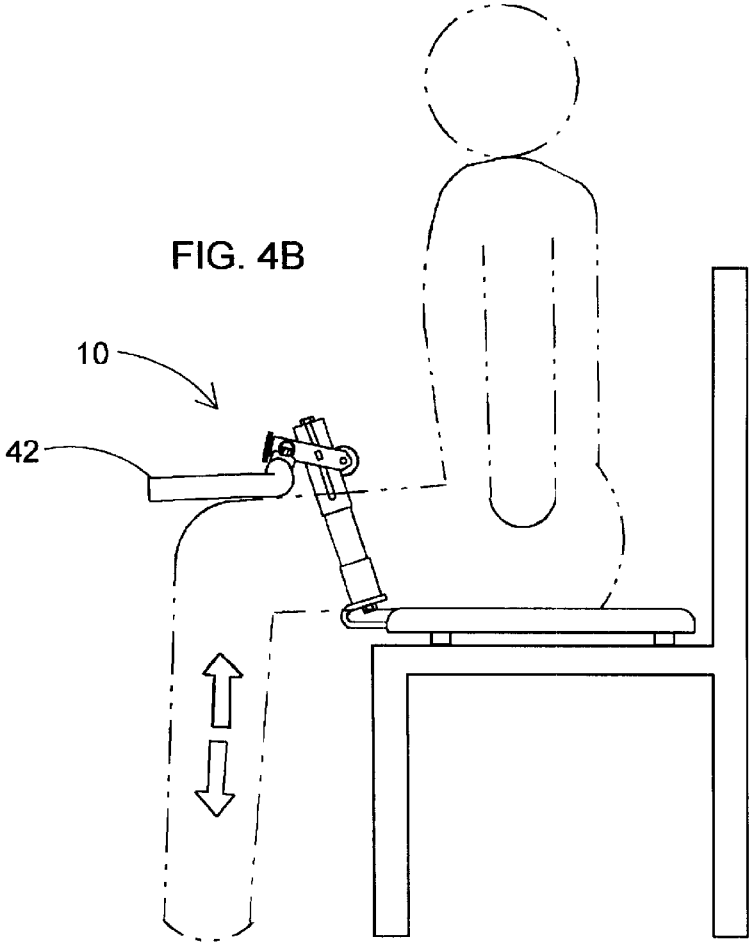
FIG. 4B is a reduced schematic silhouette of the device of FIG. 4A, now supported upon the seatable portion of an armless chair with a user seated to straddle the device mast and in position to exert his thighs upwardly and reciprocally against the tensioning means of the device, and user lifts one leg at a time 4–8 inches off the floor to exercise their thigh muscles.
Figure 6:
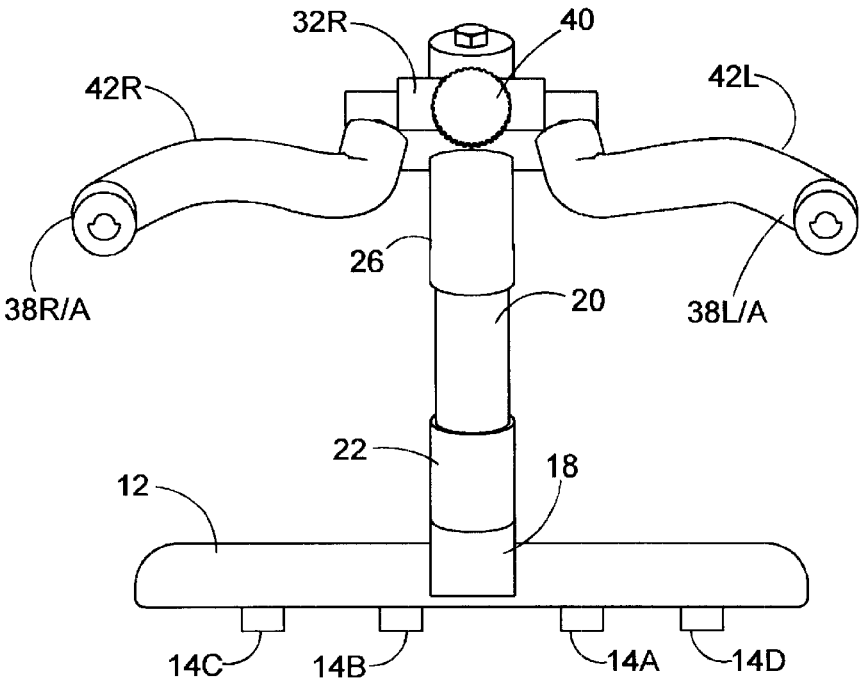
FIG. 6 is a front end elevational view of the device of FIG. 4A, also isolated from any underlying support means.
Figure 5A:
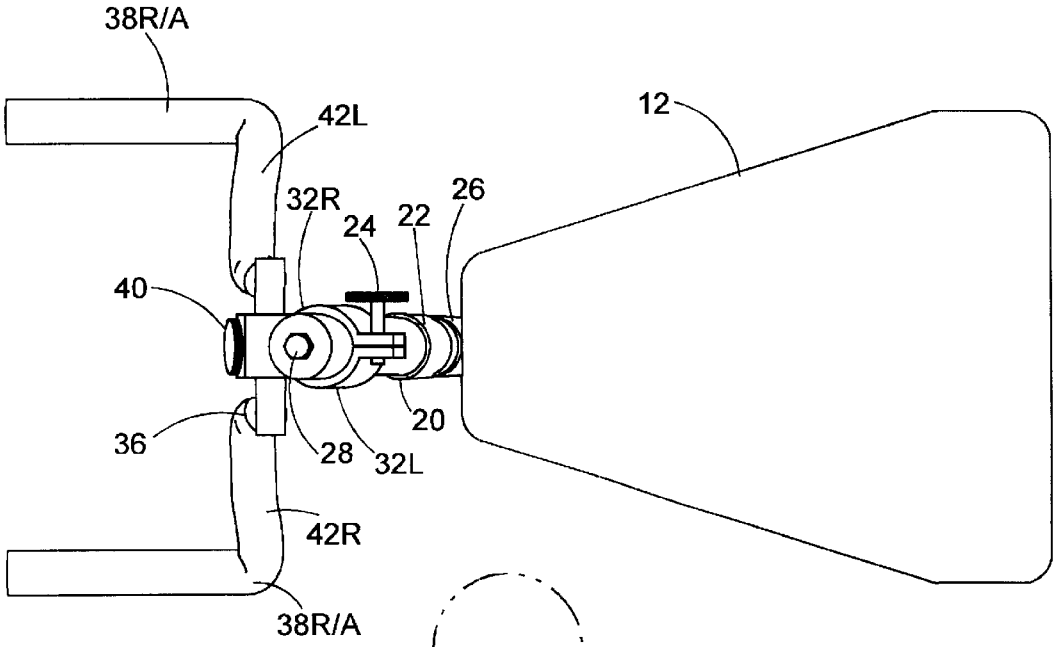
FIG. 5A is a top elevational view of the device of FIG. 4A, also isolated from any underlying support means in which the handles are oriented in a horizontal direction.

The top plan view of FIG. 5A is oriented for the thighs exercise, by lifting one leg at a time up to six inches off the floor. The schematic of FIG. 4B (connected) depicts the correct juxtaposition for the handles.

Figure 5B:
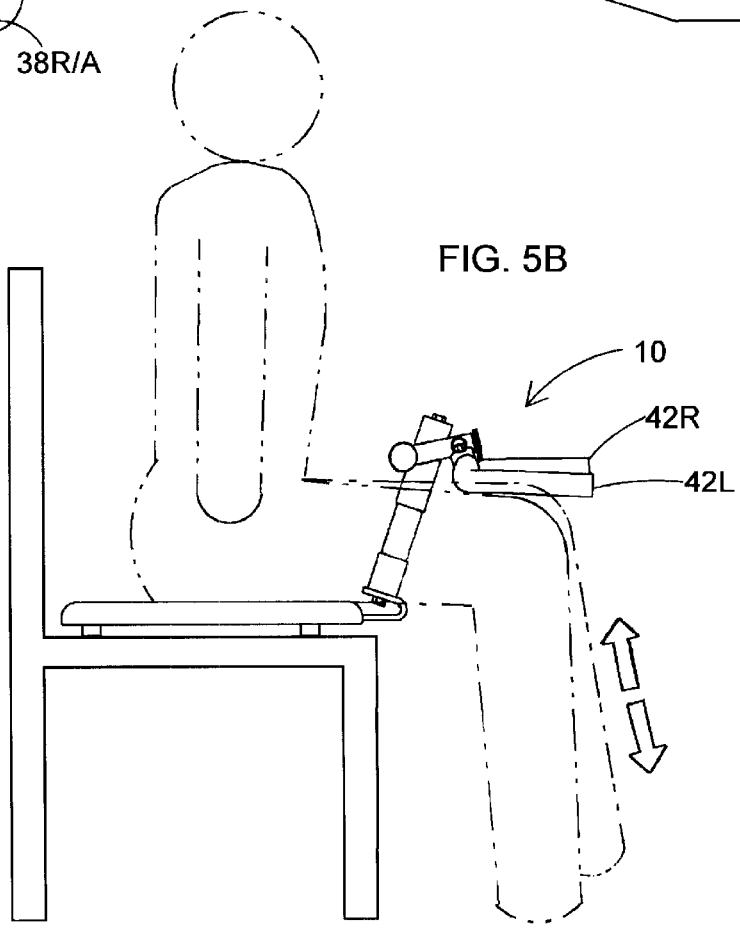
FIG. 5B is a reduced silhouette view of the user doing the lower ABS and calf exercise with hands at rest with the user performing simultaneous toe raising exercises.

With the handle bar 42 orientation depicted in FIG. 5B, the lower ABS and calves exercise is conducted. The user performs toe raises off the floor, which tilts the bars upwardly on the bar pressured side of the body thereby exercising both the calves and lower ABS.

The exercises are conducted in the depicted machine mode are all effected by the exertion of the thigh and/or leg muscles of the seated user upon the handles. Only the position of bars 38 have been altered, simply by the arcuate rotation thereof, to present themselves in an outwardly and downwardly orientation. As noted earlier, the location of handles-support bracket 32, along grooving track 30L of collar 26, can be varied to suit the physical dimensions of a device user, ranging from a petite lady of 5' plus up to a professional athlete having a frame of 6' plus.

The resilient mast 20 is preferably molded of a polyurethane resin or could be a coiled spring, or other resilient component. It should have the inherent property of being able to flex for each pound of force exerted laterally at one free longitudinal end thereof. It should be of a flexible elastomeric material, affording repetitive resistance to deformation stress, and which flexes and releases energy in response to force application by the device user. The mast may be provided with interchangeable and alternate resilient members, each mast with a different degree of resilient resistance. In a preferred mast embodiment, the range is about 10 pounds minimum to 200 plus pounds maximum resilient resistance.

All other components of the present device are fabricated from readily available metallic stock bars and rods, or device component inventories. The seating components and arched handlebars are available from manufacturers of such components as employed for other consumer products.

In the horizontal cross-sectional view of FIG. 7A, there is shown how bracket 36 encloses and tracks vertically along collar 26, by the use of external linear slot 30L on the collar. An inwardly oriented, linear ridge 60 is provided on the sidewall of bracket 36, serving to track along linear slot 30L of collar 26. Collar 26, in turn, is secured on the upper end of resilient mast 20 by bolt 28.

Looking to FIG. 7B, which is a sectional view taken through FIG. 7A along lines 7B—7B, the configuration of linear inward ridge 60 collar 26 is better seen. This interconnection of components permits the bracket component 36 to ride reciprocally along slot 30L. The laterally-mounted threaded knob 62 is employed to tighten the longitudinal ends, 64L/R, on bracket 36, so to lock in the chosen vertical posture of the bracket and associated gripping bars 42 along the essentially vertical mast 20.

IN OPERATION

Averting to the schematic view of FIG. 1B (the device being in the juxtaposition of FIG. 1A), the user is seated upon the machine cushion seat 12 with his crooked arms extended outwardly and his hands gripping (overhand) the handlebars 38 of device 10. User then rocks back and forth (one routine), or side to side (another routine or combination thereof), to exercise his abdominals and obliques. The resistance is provided to either of these exercise sets by mast member 20, as earlier described. Upon relaxing of the arms exertion, this returns the mast inwardly to the depicted outwardly slanted position, with the handlebars still extended outwardly and upwardly. This is labeled the upper ABS exercise routine.

Averting to the schematic view of FIG. 4B (the device being in the juxtaposition of FIG. 4A), user is seated upon the machine cushion seat 12 (not shown) of device 10, with both arms being at rest along his lateral sides. Upon disconnect of the spring-loaded, knob 40 from arrest upon rod 36, this allows the handlebars to rotate arcuately and come to rest atop the closed thighs 42 of the device user. The user pushes upwardly with his knees, via toe raising exercises, to exercise the lower ABS and calf-soleus muscles. His relaxing of the knee exertion returns the mast to the depicted (FIG. 5B) outwardly slanted position, and the handlebars remain in their undeflected depending position.

As mast 20 is normally disposed at an outward slant from the vertical, the user can use it to provide resistance upon lifting of the thighs one leg at a time 4–8 inches off the floor. To exercise one's thighs, there occurs an alternate lifting of one thigh/leg, then the other. This alternate lifting of one leg, then the other, up to six inches off the floor, effects the quadriceps muscles.

What is claimed is:

1. A variable mode abdominal exercise device comprising:

(a) a base seating member having a forward edge and a rearward edge;

(b) an elongated rigid first member which is secured lengthwise of the undersurface of the seating member and having one longitudinal free end thereof extending beyond the forward edge of the seating member terminating in an acute angle configuration;

(c) an elongate resilient member having a longitudinal lower end and a longitudinal upper end, such resilient member extending generally upwardly and outwardly from the forward edge of the seating member;

(d) means for pinning the lower end of the resilient member to the longitudinal free end of the rigid first member;

(e) a collar-like member mounted proximal to the upper longitudinal end of the resilient member and adapted to provide means for the interlocking support thereof with other components;

(f) a bracket means having inner and outer longitudinal ends operatively engaging the collar-like member in a reciprocal slidable mode, and being adapted for variable positioning along the elongate length of the collar-like member;

(g) a first locking means proximal the inner longitudinal end of the bracket means adapted for fixing the position thereof relative to the collar-like member; and, (h) a grippable bars assembly mounted to and adapted for axial rotation about the outer longitudinal end of the bracket means.

2. The device of claim 1 wherein the collar-like member is provided with a pair of diametrically opposing elongate linear slots located along the outer surface thereof, which slots track the variable bracket means movement upwardly and downwardly for user height adjustment.

3. The device of claim 1 wherein the bracket means is provided with a pair of opposing linear elongate ridges adapted for tracking within the opposing pair of elongate linear slots provided in the outer periphery of opposing collar-like means.

4. The device of claim 1 wherein the bracket means is provided with a transverse linear bore proximal to the outer end thereof adapted for pivotally engaging a central shaft segment of the handle bar assembly.

5. The device of claim 1 wherein the means for pinning the resilient member lower end to the longitudinal end of the first member is a sleeve-like fixture adapted to receive the lower end of the resilient member at its upper end and secured fixedly to the outer free end of the first elongate member.

6. The device of claim 1 wherein the bracket means is interuptably secured to the collar-like member by a thumb screw which transverses the inner end thereof and compresses the split ends of the bracket means about the upper end of the collar.

7. The device of claim 1 wherein the outer end of the bracket means is axially traversed by a second locking means that contacts the central segment of the handle bar assembly serving to retain any preset juxtaposition of the bars assembly relative to the normally set orientation of the resilient member and the bracket means.

8. The device of claim 1 wherein first member free end terminates in an acute angle configuration which supports and anchors the fastening means for anchoring the elongate resilient member to the rigid first member.

9. The device of claim 1 wherein the first locking means includes a grippable feature that provides for interruptible locking engagement with the engaged collar-like member.

10. The device of claim 1 wherein the resilient member is pitched forwardly from the vertical orientation so as to facilitate both vertical and horizontal deflection from the at rest orientation.

* * * * *